US006571990B2

(12) United States Patent
Bird

(10) Patent No.: US 6,571,990 B2
(45) Date of Patent: Jun. 3, 2003

(54) METHOD AND APPARATUS FOR ADJUSTABLY DIRECTING GRANULAR MATERIAL OUT OF A CONTAINER AND REDUCING OUTLET PRESSURE IN THE CONTAINER

(75) Inventor: Charles R. Bird, Milford, IN (US)

(73) Assignee: CTB IP, Inc., Wilmington, DE (US)

( * ) Notice: Subject to any disclaimer, the term of this patent is extended or adjusted under 35 U.S.C. 154(b) by 0 days.

(21) Appl. No.: 09/822,378

(22) Filed: Mar. 30, 2001

(65) Prior Publication Data

US 2002/0139814 A1 Oct. 3, 2002

(51) Int. Cl.[7] ..... B67D 5/06

(52) U.S. Cl. ..... 222/185.1; 222/236; 222/413; 222/561

(58) Field of Search ..... 222/1, 54, 185.1, 222/156, 196, 198, 201, 233, 234, 235, 236, 561, 413

(56) References Cited

U.S. PATENT DOCUMENTS

| | | | | |
|---|---|---|---|---|
| 1,047,755 | A | 12/1912 | Craig | |
| 1,615,878 | A | 2/1927 | Laird | |
| 2,370,709 | A * | 3/1945 | Barton | 222/196 |
| 3,223,290 | A | 12/1965 | Schuld | |
| 3,349,929 | A | 10/1967 | Berger | |
| 3,488,007 | A | 1/1970 | Neuenschwander | |
| 3,664,072 | A | 5/1972 | Lieckfeld | |
| 3,682,394 | A | 8/1972 | Shivvers | |
| 3,733,764 | A | 5/1973 | Hege | |
| 3,791,592 | A | 2/1974 | Cobb | |
| 3,880,300 | A | 4/1975 | Uhl | |
| 3,961,660 | A | 6/1976 | Vinci | |
| 4,112,634 | A | 9/1978 | Bissinger | |
| 4,208,839 | A | 6/1980 | Candy, Sr. | |
| 4,267,936 | A | 5/1981 | Pavlicek | |
| 4,327,522 | A | 5/1982 | Meadows | |
| 4,424,837 | A | 1/1984 | Farrell | |
| 4,433,707 | A | 2/1984 | Farnham | |
| 4,598,496 | A | 7/1986 | Van Daele | |
| 4,625,888 | A | 12/1986 | Thompson | |
| 4,700,893 | A | 10/1987 | Bugler, III | |
| 4,802,609 | A | 2/1989 | Morse et al. | |
| 4,867,046 | A | 9/1989 | Yoder | |
| 4,930,446 | A | 6/1990 | Huisinga | |
| 4,938,391 | A | 7/1990 | Griindler | |
| 4,972,884 | A | 11/1990 | Sovers et al. | |
| 5,158,502 | A | 10/1992 | Frost | |
| 5,238,035 | A | 8/1993 | Poussin et al. | |
| 5,280,813 | A | 1/1994 | Jackson | |
| 5,421,379 | A | 6/1995 | Geiser | |
| 5,603,359 | A | 2/1997 | Geiser | |
| 5,657,902 | A * | 8/1997 | Kraus | 222/54 |
| 5,906,293 | A | 5/1999 | Geiser et al. | |
| 6,073,802 | A * | 6/2000 | Sampson et al. | 222/54 |
| 6,182,869 | B1 * | 2/2001 | Birky | 222/196 |
| 6,299,021 | B1 * | 10/2001 | Haas | 222/54 |

FOREIGN PATENT DOCUMENTS

| | | |
|---|---|---|
| AU | 245174 | 11/1962 |

OTHER PUBLICATIONS

Brochure entitled "GrandHandlers: Low Cost Drying Systems". Sukup Grain Handlers (no date).
Brochure entitled "Spread–All Complete Offering of Grain Spreaders". Spread–All Mfg. Co. (no date).

* cited by examiner

*Primary Examiner*—Philippe Derakshani
(74) *Attorney, Agent, or Firm*—Harness, Dickey & Pierce, P.L.C.

(57) ABSTRACT

A method and apparatus for adjustably directing granular material through a container. The apparatus includes a converging transition portion defining an input opening that converges to an output opening having a first transverse opening dimension ($x_1$). The apparatus further includes an elongated chimney portion coupled to the converging transition portion and having a second transverse opening dimension ($x_2$), where the first transverse opening dimension ($x_1$) is smaller than the second transverse opening dimension ($x_2$). This configuration reduces the outlet pressure created in the converging transition portion as the granular material passes through the container to minimize bridging of the granular material within the container.

33 Claims, 5 Drawing Sheets

METHOD AND APPARATUS FOR ADJUSTABLY DIRECTING GRANULAR MATERIAL OUT OF A CONTAINER AND REDUCING OUTLET PRESSURE IN THE CONTAINER

BACKGROUND

1. Field of the Invention

This invention relates generally to storage of granular material such as animal feed, and more particularly, to a method and apparatus for adjustably directing granular material out of a container and reducing outlet pressure in the container.

2. Discussion of the Related Art

In various industries, such as those involving agriculture and manufacturing, it is often necessary to store relatively large amounts of granular material. In agriculture, for example, it is often necessary to store substantial quantities of feed for animal husbandry operations. When used in such industries, the granular material is often initially loaded into an opening located at the top of a container which is used for temporary storage of the granular material. The granular material is then later removed from the container immediately prior to use through an opening located at the bottom of a funnel-shaped portion of the container.

As the granular material is removed from the container at a lower outlet portion using a conventional boot and auger assembly, the granular material tends to unload unevenly and have a non-uniform mass flow. In worse case conditions, a side unloading condition may occur within the container, where the granular material is generally flowing out of the container more along one side of the container causing the slower flowing granular material to concentrate along a higher wall. This uneven distribution of granular material within the container may result in collar warpage or damage along the lower outlet portion and, in extreme circumstances, panels along the lower funnel shaped portion may deform or split and give way under this uneven loading of the granular material. To reduce this problem, an outlet portion having a chimney configuration is disclosed in U.S. Pat. No. 5,906,293, which is hereby incorporated by reference. However, even with the use of such a system, "bridging" of the granular material within the container may still result. This "bridging" forms in the container where pockets or portions of the granular material are removed leaving a subsequent bridge of granular material which, over time, may fall or "feed crash" within the container, further causing potential structural problems within the container. This bridging generally occurs because of a build-up in feed pressures at the outlet of the container.

Conventional boot and auger assemblies are generally coupled to the lower outlet portion of the container to provide either a horizontal delivery direction or an angled delivery direction, in which case, the auger is routed or angled upward relative to the ground. In order to provide either this horizontal routing along the ground or an upward routing to direct the granular material into other containers or into other locations, various types of individual shaped sleeves or wedge portions are utilized to provide this angled direction. However, this provides clearance problems in some assemblies by the addition of the wedge portion, as well as requires the addition of a separate component to be added to the boot and auger assembly which may be labor intensive and time consuming. Additionally, rotation of the boot and auger assembly to provide 360° directional control is generally not possible due to the way the boot and auger assembly is secured to the container.

Conventional boot and auger assemblies also require periodic cleaning to insure a smooth flow of the granular material through the auger. To achieve this, conventional boot and auger assemblies generally provide an access panel or door located adjacent to the auger which provides access to a portion of the auger once opened or removed. However, access to the entire auger assembly is generally not provided by such a panel or door mechanism which may tend to leave a portion of the granular material within the auger during this cleaning process.

Still further, conventional boot and auger assemblies generally utilize what is known as a cannon ball which rides atop or bounces on the auger as the auger is rotated to agitate and loosen the granular material as it flows into the auger assembly. The cannon ball is also generally contained or captured between a pair of baffles located above the auger assembly which directs the granular material into the auger assembly. This type of agitator works very well when the particular container is transferring granular material through the boot and auger assembly, however, when the slide gate above the boot and auger assembly is closed, thereby inhibiting granular material from being transferred, the cannon ball still engages or bounces off the auger as the continuous auger passing through the various containers is rotated. This unneeded impact creates undue noise and wear on the auger when the particular container is not transferring granular material. Moreover, by providing baffles which are fixed relative to the cannon ball, there is no level of adjustment available to fine tune or direct the amount of granular material entering the auger assembly.

What is needed then is a method and apparatus for adjustably directing granular material out of the container and reducing outlet pressure in the container without suffering from the above mentioned disadvantages. This, in turn, will reduce outlet pressure within the container, thereby reducing or eliminating "bridging" of the granular material from within the container; reduce or eliminate "feed crash" caused by "bridging;" provide a versatile lower outlet portion which may be used to both direct granular material along a horizontal plane or in an upward direction relative to the horizontal plane in one assembly, thereby reducing the overall time and labor involved in adjustably directing the granular material out of the container, as well as reducing or eliminating clearance problems; provide a rotatable coupling for the boot and auger assembly to provide 360° directional control of the granular material; provide an agitator which may be elevated above the auger assembly when not in use, thereby reducing undue noise and wear on the auger assembly; and provide a boot and auger assembly which may be easily accessed to provide a thorough cleaning of the boot and auger assembly. It is, therefore, an object of the present invention to provide such a method and apparatus for adjustably directing granular material out of a container and reducing outlet pressure in the container.

SUMMARY OF THE INVENTION

The present invention is directed to a method and apparatus for adjustably directing granular material out of a container and reducing outlet pressure in the container. This is essentially achieved by providing a first transverse opening dimension ($x_1$) which is smaller than a second transverse opening dimension ($x_2$), such that as the granular material passes through this area, pressure relief is achieved to eliminate bridging of the granular material within the container.

In one preferred embodiment, an apparatus for directing granular material through a container includes a converging transition portion and an elongated chimney portion. The converging transition portion defines an input opening that converges to an output opening. The output opening has a transverse opening dimension ($x_1$). The elongated chimney portion is coupled to the converging transition portion adjacent the output opening and has a second transverse opening dimension ($x_2$). The first transverse opening dimension ($x_1$) is smaller than the second transverse opening dimension ($x_2$). This enables the granular material to pass through the output opening having the first transverse opening dimension ($x_1$) into the elongated chimney portion having the second transverse opening dimension ($x_2$), thereby relieving the outlet pressure created in the converging transition portion to minimize bridging of the granular material within the container.

In another preferred embodiment, an apparatus for directing granular material through a container includes a first cylindrical inclined portion, a second cylindrical inclined portion and a coupling flange. The first cylindrical inclined portion is coupled to the container and the second cylindrical inclined portion is rotatably coupled to the first cylindrical inclined portion. The coupling flange is disposed along a first inclined edge of the first cylindrical inclined portion and disposed along a second inclined edge of the second cylindrical inclined portion, such that the second cylindrical inclined portion may be rotated relative to the first cylindrical inclined portion to adjustably change the direction of routing the granular material out of the container.

In yet another preferred embodiment, a container for storing granular material includes a cover portion, a sidewall member, a converging portion, a lower outlet portion and a rotatably coupling mechanism. The cover portion substantially covers the granular material stored in the container. The sidewall member has an upper portion and a lower portion with the upper portion attached to the cover portion and the sidewall member being operable to confine the granular material stored in the container. The converging portion is attached to the lower portion of the sidewall member and is operable to guide the granular material to an outlet in the converging portion. The lower outlet portion is operable to direct the granular material out of the container. The rotatable coupling mechanism is disposed between the converging portion and the lower outlet portion and is operable to permit the lower outlet portion to be rotated relative to the container to rotatably direct the granular material out of the container.

In another preferred embodiment, a method for directing granular material through a container is disclosed. This method includes providing a converging transition portion having a converging sidewall that converges to an output opening having a first transverse opening dimension ($x_1$), providing an elongated chimney portion having a second transverse opening dimension ($x_2$) with the first transverse opening dimension ($x_1$) being smaller than the second transverse opening dimension ($x_2$), coupling the elongated chimney portion to the converging transition portion, filling the container with the granular material, and moving the granular material from the container through the converging transition portion and the elongated chimney portion, whereby relief of outward feed pressure generated in the converging transition portion is created.

Use of the present invention provides a method and apparatus for adjustably directing granular material through a container. As a result, the aforementioned disadvantages associated with the currently available methods, and techniques for storing and removing granular material from a container have been substantially reduced or eliminated.

BRIEF DESCRIPTION OF THE DRAWINGS

Still other advantages of the present invention will become apparent to those skilled in the art after reading the following specification and by reference to the drawings in which.

DETAILED DESCRIPTION OF THE PREFERRED EMBODIMENTS

The following description of the preferred embodiment of the present invention is merely exemplary in nature and is not intended to limit the invention or its application or uses. Moreover, while the present invention is described in detail below with reference to storing food for animal husbandry operations, those skilled in the art will readily recognize that the container may be used to store any type of granular material.

Figure 1:
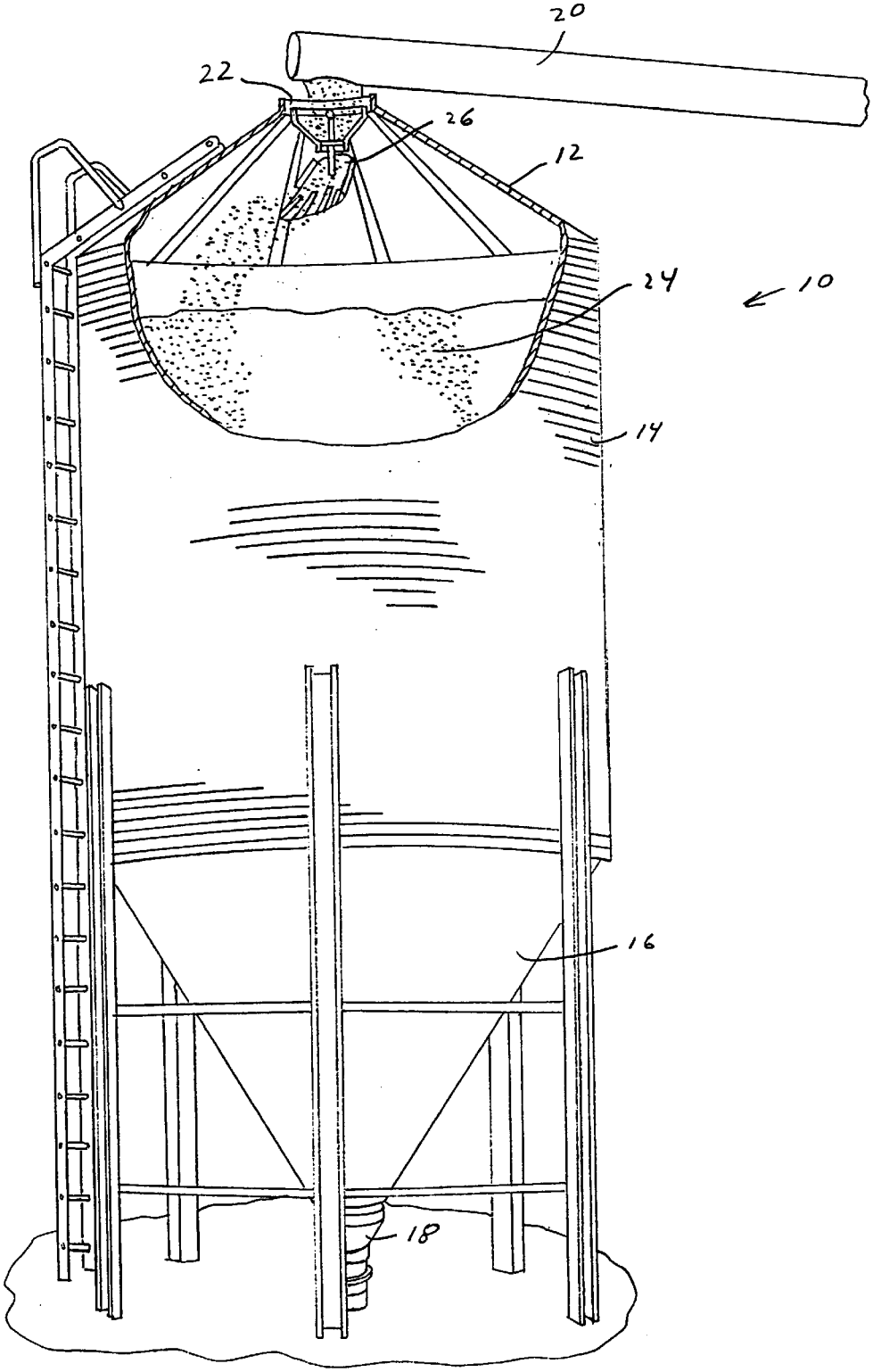
FIG. 1 is a perspective view, partially broken away of a container for storing granular material according to the teachings of the preferred embodiment of the present invention.

Referring to FIG. 1, a container 10 for storing granular material such as grains, feed, food products or other granular materials for agricultural or industrial use is shown. The container 10 includes an upper cover portion 12 which is used to cover the granular material within the container 10. The cover portion 12 may include a lid and corresponding opening device (not shown) which is disclosed in U.S. Pat. No. 4,744,183, which is hereby incorporated by reference. The container 10 further includes a generally cylindrical sidewall portion 14 which is used for containing the granular material within the container 10. Attached to the cylindrical sidewall portion 14 is a lower funnel shaped portion 16 which is used for guiding the granular material downward into a lower outlet portion 18, according to the teachings of the present invention.

The container 10 receives an inflow of granular material from a dispensing device 20, such as an auger or a downspout. In this regard, the granular material enters the lower portion (not shown) of the dispensing device 20 and delivers the granular material to an open end 22 of the container 10. The granular material, identified by reference numeral 24, is evenly distributed within the container 10 by way of a distributing device 26, such as that disclosed in U.S. Pat. No. 5,421,379, which is hereby incorporated by reference.

Preferably, the cover portion 12 is generally conical in shape and has an angle of inclination which is substantially equal to the angle of repose of the granular material 24. For example, if the granular material 24 is chicken feed, which has an angle of repose of approximately 40°, then the angle of inclination of the cover portion 12 is preferably also approximately 40°. Because the angle of inclination of the cover portion 12 is relatively large, a greater amount of granular material 24 can be stored within the container 10. This is because the volume of the container 10 defined by the walls of the cover portion 12 is larger than when the angle of inclination of the cover portion is lower. In addition, by having the angle of inclination of the cover portion 12 not greater than the angle of repose of the granular material 24, the space or void created between the granular material 24 and the inner surface of the cover portion 12 is minimized. It will be appreciated that the presence of these spaces or voids may otherwise tend to cause the granular material 24 to degrade, such as by the formation of mold.

As will be appreciated by those skilled in the art, the container 10 may be a feed storage bin of the type which is available from Chore-Time or Brock, Milford, Ind. However, it will be understood that the present invention may be used with other types of containers, as well as used for distributing other types of granular materials. In this regard, the container 10 may be used for storing other types of agricultural materials, consumable materials, industrial materials, chemical material, as well as virtually any type of granular material. In addition, while the container 10 is shown as being generally cylindrical in shape with a conically shaped cover portion 12, the container 10 may be of virtually any other shape which is suitable for storing the granular material. Accordingly, the container 10 may be rectangular, hexagonal, octagonal or any other suitable shape.

Figure 2:
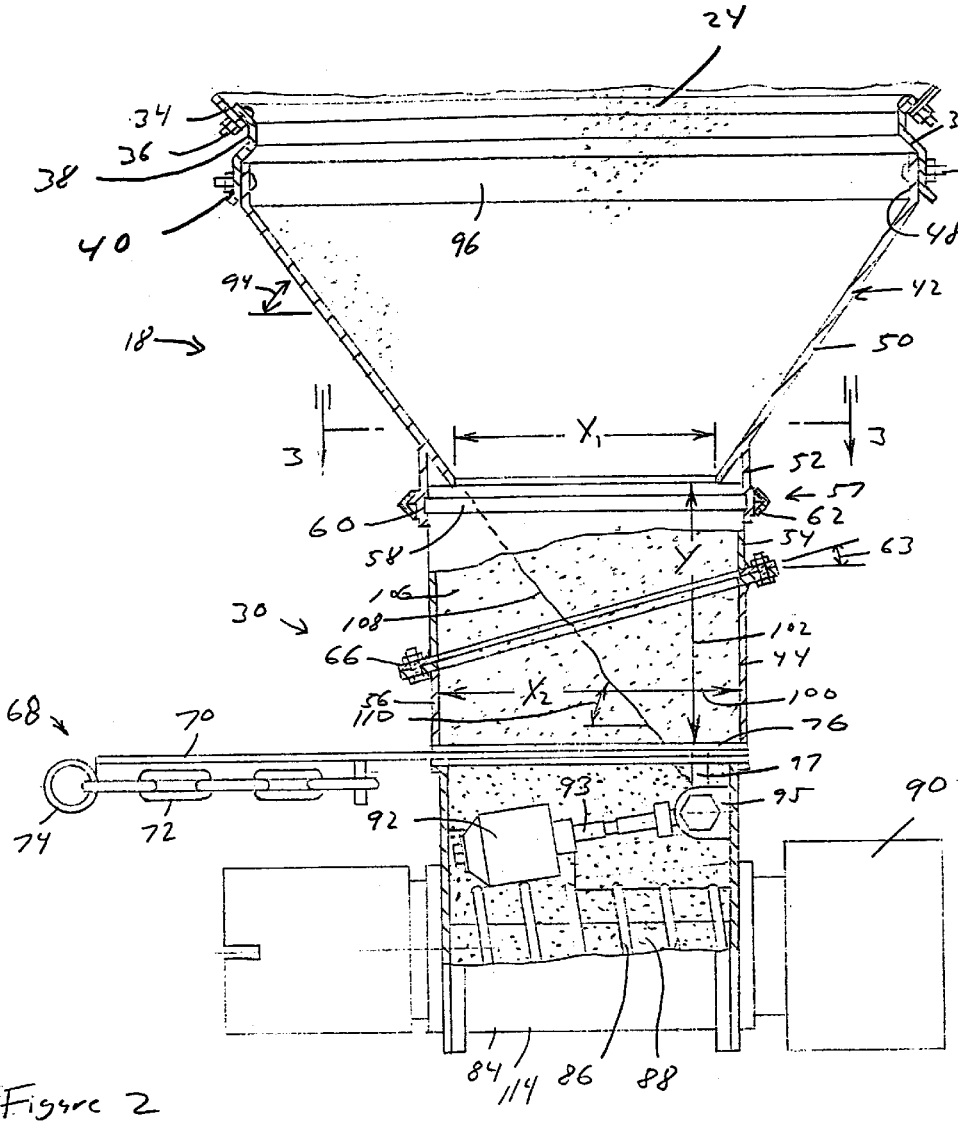
FIG. 2 is a partial side cross-sectional view of an apparatus for adjustably directing granular material out of the container and reducing outlet pressure in the container according to the teachings of the present invention.

Referring to FIG. 2, the lower outlet portion 18, generally known as a boot and auger assembly, according to the teachings of the present invention is shown in further detail. The boot and auger assembly 30, is fixedly secured to the lower funnel shaped portion 16 by means of a circular re-enforced collar 32. The collar 32 includes a conical sidewall portion 34 which is bolted to the inside of a lower funnel shaped portion 16 with bolts 36. The collar 32 further includes a first cylindrical sidewall portion 38 and a second cylindrical sidewall portion 40 which has a larger diameter than the first cylindrical sidewall portion 38. The larger diameter of the second cylindrical sidewall portion 40 provides clearance for the thickness of the boot and auger assembly 30, as well as the bolts 34. In this way, as the granular material or grain 24 passes through the cylindrical sidewall portion 38, it is not restricted as it enters the boot and auger assembly 30.

The boot and auger assembly 30 includes an upper boot portion 42, an elongated cylindrical chimney portion 44 and a lower or auger boot portion 46. The upper boot portion 42 includes a cylindrical lip 48 which is fixedly secured to the collar 32 by way of bolts 36. The upper boot portion 42 further includes a conical or converging transition portion 50 and a cylindrical sleeve portion 52 which is part of converging transition portion 50.

The cylindrical chimney portion 44 includes a first cylindrical inclined portion 54 and a second mating cylindrical inclined portion 56. The first cylindrical inclined portion 54 is secured to the upper boot portion 42 by way of a rotatable coupling mechanism 57 formed by an annular bead 58 that is received within an annular groove 60 of the sleeve portion 52. Upon mating the annular bead 58 with the annular groove 60, a V-band compression clamp 62 is positioned about the sleeve 52. The V-band compression clamp 62 is simply tightened to fixedly retain the chimney portion 44 relative to the upper boot portion 42. In this way, should the direction of the lower auger boot portion 46 need to be changed to direct the granular material 24 to a different location, the cylindrical chimney portion 44 and the lower auger boot portion 46 may simply be rotated 360° relative to the upper boot portion 42 by simply loosening the V-band clamp 62. This is in contrast to existing systems which generally are integral or bolted through, thereby not enabling such adjustment and either requiring drilling of holes and sealing of existing holes or replacement of the transition portion 50 altogether.

The upper cylindrical inclined portion 54 and the lower cylindrical inclined portion 56 each have an angle of 15°, identified by reference numeral 63, relative to the horizontal axis. The first cylindrical inclined portion 54 is rotatably retained relative to the second cylindrical inclined portion 56 by way of a rotatable flange connection 66 located along each respective inclined edge. In this regard, this rotatable flange 66 provides for a chimney 44 that may either be a vertical cylinder or have a 30° transition (see FIG. 5) upon rotating the second cylindrical inclined portion 56 180° relative to the first cylindrical inclined portion 54 along the rotatable flange connector 66, further discussed herein.

Figure 9:
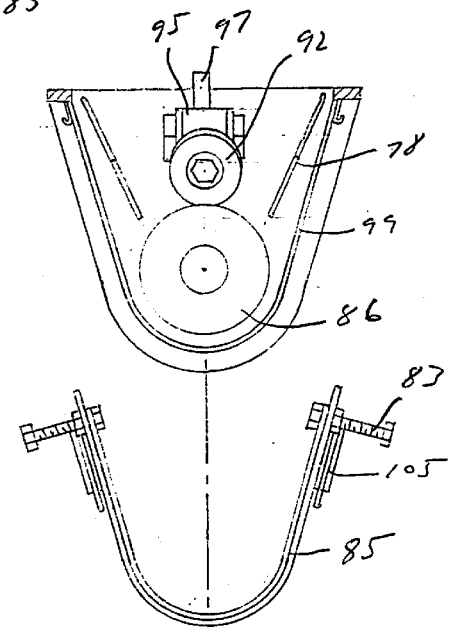
FIG. 9 is a front cross-sectional view illustrating the adjustable baffles positioned within the preferred boot and auger assembly.
Figure 10:
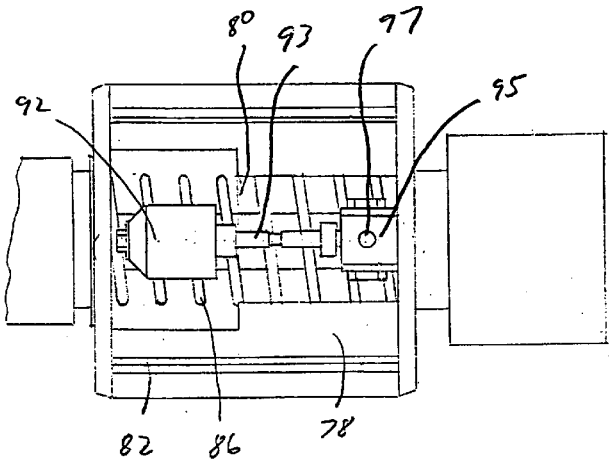
FIG. 10 is a top view of the baffles and agitator of the preferred boot and auger assembly.

Attached to the lower most portion of the second cylindrical inclined portion 56 is a closure mechanism 68. The closure mechanism 68 includes a slide plate 70, a chain 72, and a handle 74 which, when pulled, slides the slide plate 70 within the track 76 to expose the lower boot portion 46 to the grain 24. Located within the lower boot portion 46 are an optional pair of adjustable baffles 78 (see FIGS. 9 and 10) which guide the grain 24 to an opening 80. The adjustable baffles 78 are secured within the lower boot portion 46 by means of pivot tabs or rods 82. The angle of the adjustable baffles 78 may be adjusted by a pair of adjustment screws 83 which pass through a removable panel 85, further discussed herein. Located at the lower-most portion of the lower boot portion 46 is an auger tube assembly 84. Upon rotating the adjustment screws 83, the amount of granular material entering the auger tube assembly 84 may be further controlled.

The auger tube assembly 84 includes a centerless auger 86, a restrictor tube 88 and an anchor bearing assembly 90. The centerless auger 86 is rotatably secured and the restrictor tube 88 is fixedly secured relative to the anchor bearing assembly 90. A pivoting agitator 92 is also located within the lower boot portion 46 and acts to agitate the grain 24 as the auger 86 is rotated. The auger tube assembly 84 may be an auger tube assembly of the type which is available from Chore-Time or Brock, Milford, Ind., known as a Chore-Time Flex-Auger or may consist of twin boot augers also available from Chore-Time or Brock or any other appropriate auger tube assembly.

Figure 6:
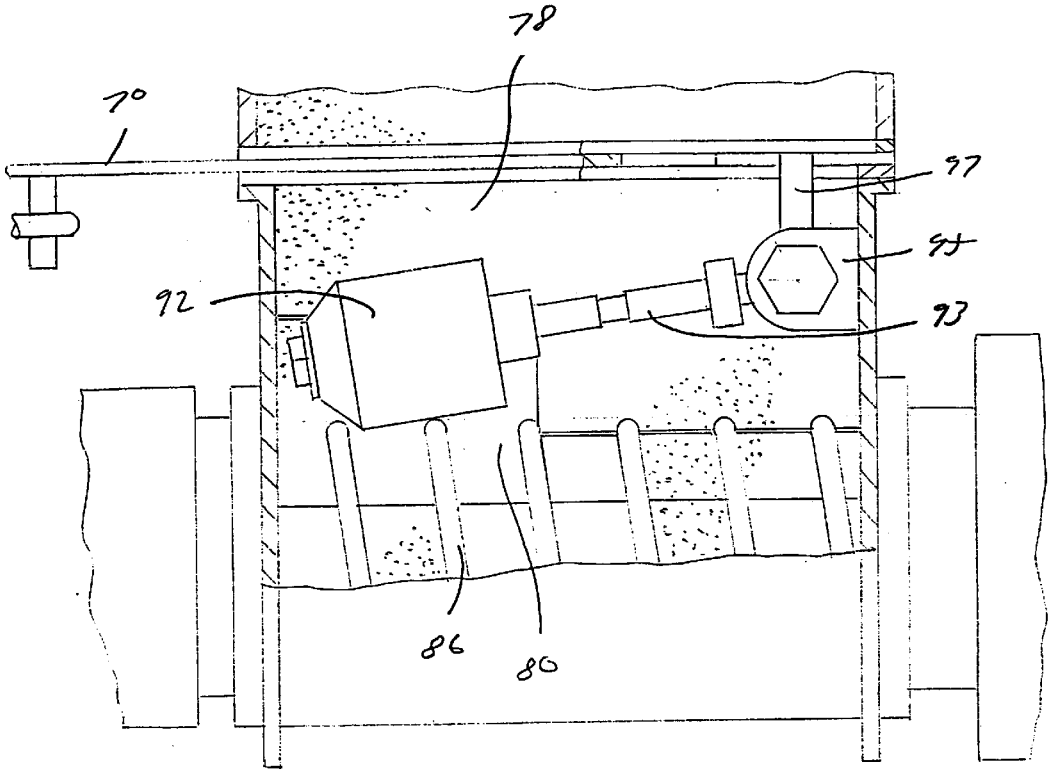
FIG. 6 is an enlarged cross-sectional view of an agitator used in the preferred boot and auger assembly with an open slide gate.
Figure 7:
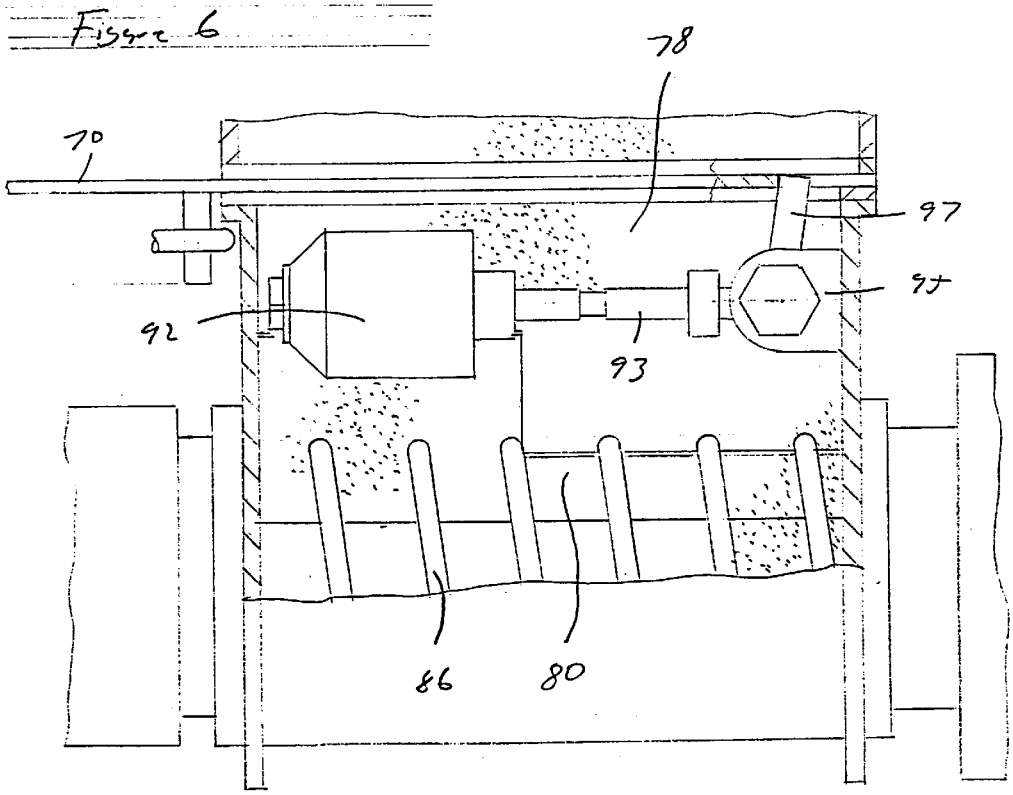
FIG. 7 is an enlarged cross-sectional view of an agitator used in the preferred boot and auger assembly with a closed slide gate.

Referring specifically to FIGS. 6 and 7, the pivoting agitator 92 is substantially cylindrically shaped and rotates about a pivot shaft 93. The pivot shaft 93 is pivotably coupled to the lower boot portion 46 by way of a pivoting yoke 95 having an engagement member 97. In this regard, when the slide plate 70 of the closure mechanism 68 is open, the agitator 92 engages the centerless auger 86 such that as the centerless auger 86 is rotated, the pivoting agitator 92 rotates about the pivot shaft 93, as well as rides atop or bounces on the centerless auger 86. This action agitates or loosens and separates the granular material 24 as it passes through opening 80 between the optional angled baffles 78. The use of both the pivoting and rotating effect of the agitator 92 enhances disbursement and separation of the grain 24.

When the container 10 empties or it is no longer desired to transport grain 24 from the container 10, the slide plate 70 is slid closed. Upon closing the slide plate 70, the slide plate 70 contacts the engagement member 97 which pivots and raises the agitator 92 above the centerless auger 86. By elevating the agitator 92 above the centerless auger 86 so that the agitator 92 is no longer in contact with the centerless auger 86, wear in the centerless auger 86 is reduced, while also eliminating a substantial amount of noise caused by the agitator 92 engaging the auger 86. This condition is particularly important when several containers 10 are coupled along the same centerless auger 86 because the centerless auger 86 always rotates with respect to each container 10. Thus, by simply closing the slide plate 70, the agitator 92 is elevated above the auger 86 in that particular container 10, thereby reducing wear and noise during slide management of the container 10. It should further be noted upon reference to FIG. 10 that the optional adjustable baffles 78 closely conform to the shape of the pivoting agitator 92 and the shaft 93 to provide enhanced control and adjustment of the granular material out of the opening 80. Alternatively, the baffles 78 may be eliminated to open the lower boot portion 46 fully and eliminate this additional adjustment.

Figure 8:
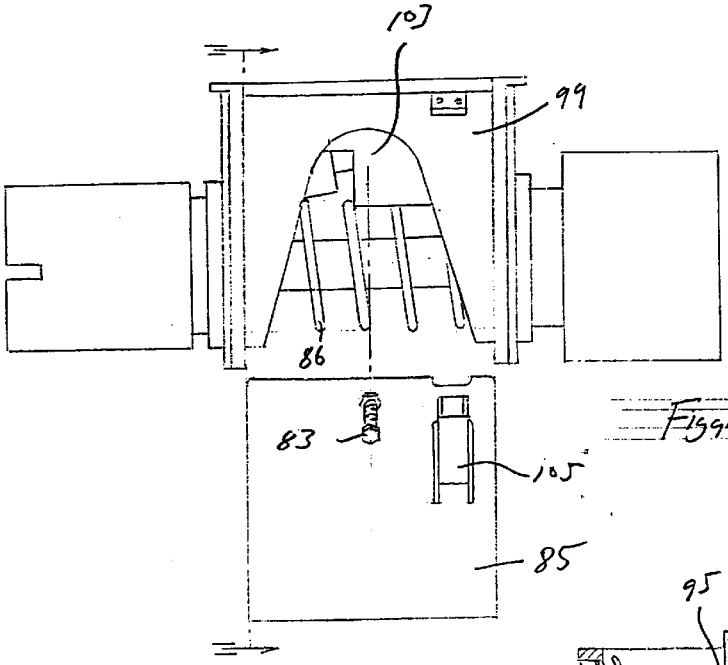
FIG. 8 is a side view of a drop away panel shown detached from the preferred boot and auger assembly.

Turning to FIG. 8, further detail of the lower boot portion 46 is provided. In this regard, the lower boot portion 46 which houses the auger tube assembly 84 includes an internal sidewall 99 which houses the adjustable baffles 78 and the external removable panel or sidewall 85 which includes the adjustment screws 83. The internal sidewall 99 defines a large U-shaped opening 103 which exposes the entire auger 86 when the external sidewall 85 is removed from the internal sidewall 99. The opening 103 is substantially symmetrical on both sides of the lower boot portion 46, as well as extends above the auger 86 to provide easy access for cleaning in this region, by simply removing the external sidewall 85. The external sidewall 85 is coupled to the internal sidewall 99 by a pair of latches 105 which latch the uppermost portion of the external sidewall 85 with the uppermost portion of the internal sidewall 99 on both sides of the lower boot portion 46. To clean the auger tube assembly 84 or gain access for repairs, the pair of latches 105 are simply disengaged to remove the external sidewall or panel 85 from the internal sidewall or panel 99. This is in contrast to existing systems which simply provide a trap door or panel which does not expose the entire auger 86.

The conical transition portion 42 may be comprised of a transparent polymeric material and the chimney portion 44 may be formed from cast aluminum or manufactured of galvanized steel. The conical transition portion 42 has about a 52° included angle, or about a 26° angle relative to the vertical plane, or an angle of about 64° relative to the horizontal plane, identified by reference numeral 94. Should additional clearance be required in the area, the angle of the conical transition portion 42 may be adjusted accordingly. The entrance to the conical transition portion 42 is defined by a circular input opening 96 having a diameter of about 17.5 inches to about 26.5 inches which tapers to a circular output opening 98 having a diameter or transverse opening dimension ($x_1$) of about seven inches (7"). Upon entering the cylindrical chimney portion 44, the diameter expands to about eight inches (8") or an enlarged transverse opening dimension ($x_2$) 100. The cylindrical chimney portion 44 maintains the eight inch (8") diameter and has a height (y) of about seven inches (7"), where the diameter ($x_2$) is identified by reference numeral 100 and the height (y) is identified by reference numeral 102. This still provides for a ratio of about 1:1 for the exit opening ($x_1$) 98 relative to the height (y) 102 similar to that disclosed in U.S. Pat. No. 5,906,293, which is hereby incorporated by reference. This configuration provides for a substantially uniform mass flow of the granular material 24 out of the container 10.

In this regard, to create and maintain a uniform mass flow out of the container 10, the output opening 98 should be about the same as the height 102 if the angle of repose to the granular material 24 is about 40° to 45°. In other words, a flow pattern is achieved in the cylindrical chimney portion 44 such that as the grain 24 is fed from the right to the left with the centerless auger 86, a right to left mass flow 104 begins within the chimney portion 44. A slower mass flow or static flow of grain 106 is then positioned from the left to right in the chimney portion 44 creating a transition region 108 having an angle 110 which is substantially similar to the angle of repose of the granular material 24.

To further eliminate or prevent "bridging" of the granular material from within the container 12, the outlet opening 98 having a first diameter or a smaller diameter of seven inches (7") transitions to the chimney diameter 100 having a second larger diameter. By providing this increased diameter (i.e., $x_2>x_1$), pressure relief is achieved below the outlet opening 98, as shown clearly in FIG. 4 thereby relieving of the outward feed pressures created in the converging transition portion 42 to minimize the tendencies for bridging of the feed 24. In this regard, the flow pattern of the grain 24 is shown where the grain 24 passes through the outlet opening 98 having a buildup pressure created in the converging transition portion 42 which is thereby relieved upon entering the enlarged diameter chimney portion 44.

Figure 3:
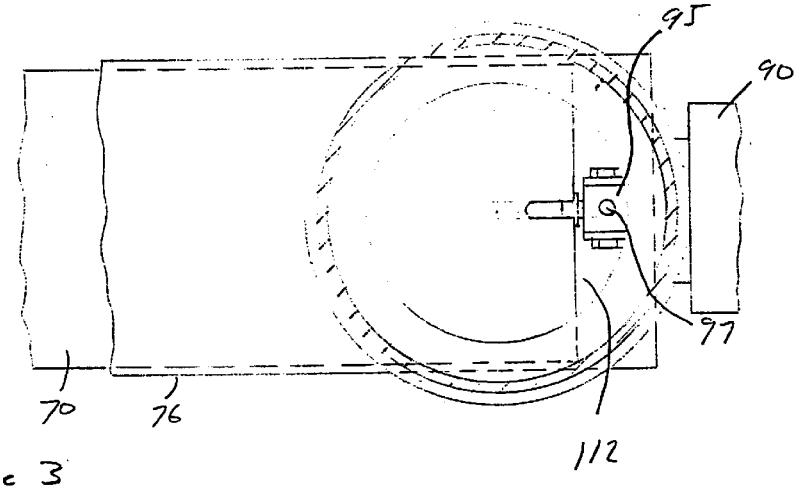
FIG. 3 is a sectional view of the apparatus of FIG. 2 taken along line 3—3.
Figure 4:
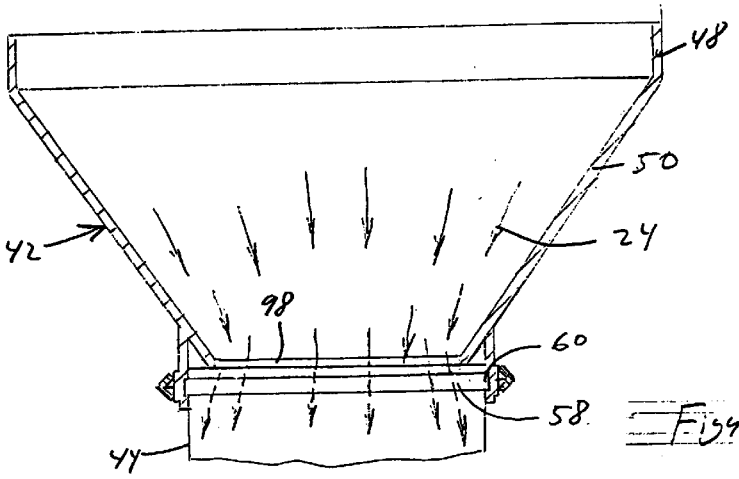
FIG. 4 is a partial side cross-sectional view of the apparatus of FIG. 2 illustrating the flow pattern of the granular material.

The method for reducing the outlet feed pressure from outlet 98 of the container 10 will now be described with reference to FIGS. 2–4. Initially, the container 10 is evenly filled with the granular material 24 by use of the filling apparatus 26 as the granular material 24 is delivered by the dispensing device 20. Once the container 10 has been filled with the granular material 24, the slide plate 70 is slid open along the groove 76 utilizing the handle 74 and chain 72 or an automated device or motor. The slide plate 70 may either be only partially open to expose an opening 112, as shown in FIG. 3, as will generally occur during slide management or fully opened. With the slide plate 70 opened, the agitator 92 lowers or engages the centerless auger 86 as the centerless auger 86 is rotated in a clockwise manner utilizing a motor remote from the auger assembly 84. As the centerless auger 86 is rotated in the clockwise manner, the grain 24 begins to flow out of the output tube 114 to a desired location through additional conventional tubes enclosing the centerless auger 86. In order for the grain 24 to be removed without creating bridges of grain 24 within the container 10, the outlet opening 96 having a first smaller diameter is positioned relative to the elongated chimney portion 44 having a second larger diameter. Thus, as the grain 24 flows from the converging transition portion 42 through the outlet portion 98 into the enlarged elongated chimney 44, pressure release is provided by the enlarged diameter of the elongated chimney portion 44 (i.e., $x_2 > X_1$).

Figure 5:
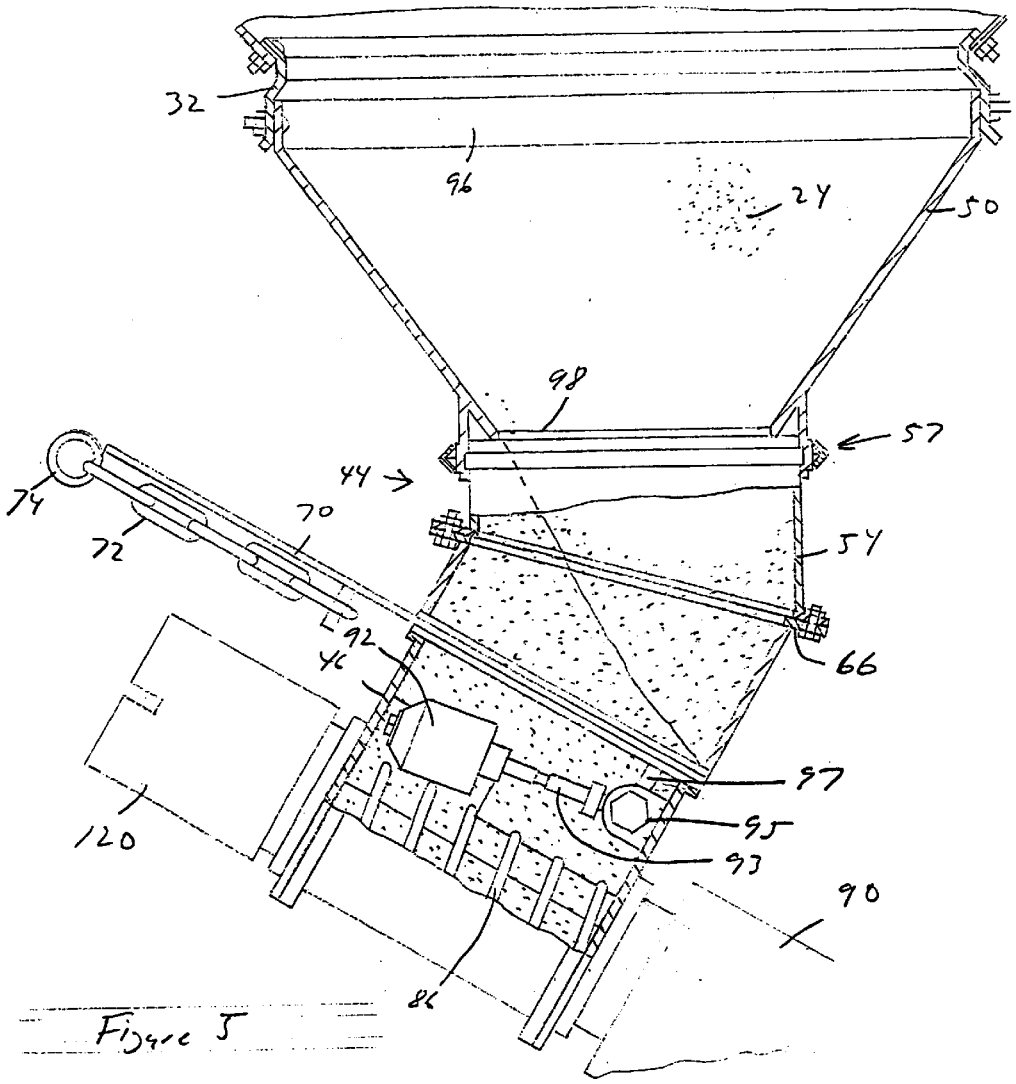
FIG. 5 is a partial side cross-sectional view of the apparatus of FIG. 2 with a portion of the apparatus rotated 180° to adjustably direct the granular material out of the container.

Turning now to FIG. 5, the elongated chimney portion 44 is shown angled at about 30° relative to a horizontal plane, identified by reference numeral 116. In this regard, the second cylindrical inclined portion 56 is rotated relative to the first cylindrical inclined portion 54, via the rotatable connection or flange 66. In this regard, the flange 66 only provides two choices or mounting hole arrangements between parts 54 and 56. The first choice is directed to the vertical orientation of the cylindrical chimney portion 44, shown in FIG. 2 and the second choice is shown in the 30° incline, as shown in FIG. 5. This adjustability for directing the grain 24 out of the container 10 enables the grain 24 to either be directed along a horizontal direction or upward into another container or at a different location. By providing this angled rotatable coupling mechanism 66, the need for having separate wedge portions which would be added to cylindrical chimney 44 is eliminated, thereby eliminating any clearance concerns by adding an extra component, as well as reducing time and labor to change the direction or routing of the granular material 24 out of the container 10. It should further be noted that the flow patterns or the height of the ($x_1$) to the (y) direction is substantially maintained by either configuration shown in FIG. 2 or FIG. 5.

Accordingly, the present invention reduces or eliminates bridging of the granular material 24 by way of providing an outlet portion 18 having a first diameter 98 which empties into an elongated chimney portion 44 having a second larger diameter 100 to provide for pressure relief created by the converging transition portion 42. Additionally, by providing an elongated chimney portion 44 that is created in two cylindrical inclined components 54 and 56 that may be rotated relative to one another, this enables a single elongated chimney portion 44 to be used to route the grain 24 along a horizontal plane or along an incline plane of about 30° upon rotating the second cylindrical incline component 56 relative to the first cylindrical incline component 54. Moreover, by also providing a rotatable coupling mechanism 57 between the chimney portion 44 and the converging transition portion 42, via the sleeve 52 and the clamp 62, this enables the entire lower unit to be rotated 360° for even further versatility without the need for drilling additional mounting holes or sealing previously drilled holes, thereby reducing the overall time and labor to make such directional adjustments. Still further, by providing a removable external sidewall or panel 85, the lower boot portion 46 may be easily cleaned by exposing the entire auger 86 upon simply moving the panel 85 from the internal panel or sidewall 99. Finally, by providing optional adjustable baffles 78 and a pivoting agitator 92, there is a reduction in noise and overall wear on the auger 86, as well as provides further versatility in adjusting the amount of granular material 24 exiting the opening 80 in the lower boot portion 46.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An apparatus for directing granular material through a container, said apparatus comprising:

a converging transition portion defining an input opening which converges to an output opening, said output opening having a first transverse opening dimension ($x_1$);

an elongated chimney portion coupled to said converging transition portion adjacent said output opening, said elongated chimney portion having a second transverse opening dimension ($x_2$), said first transverse opening dimension ($x_1$) being smaller than said second transverse opening dimension ($x_2$), whereby as the granular material passes through said output opening having said first transverse opening dimension ($x_1$) into said elongated chimney portion having said second transverse opening dimension ($x_2$), relief of outward pressures created in the converging transition portion is provided to minimize bridging of the granular material within the container; and a rotatable coupling mechanism disposed between said converging transition portion and said elongated chimney portion, said rotatable coupling mechanism operable to enable 360° rotation of said elongated chimney portion relative to the container to adjustably direct said granular material out of the container.

2. The apparatus as defined in claim 1 wherein said rotatable coupling mechanism includes an annular bead and an annular groove operable to mate with said annular bead along with a compression clamp operable to secure said elongated chimney portion relative to the container.

3. An apparatus for directing granular material through a container, said apparatus comprising:

a converging transition portion defining an input opening which converges to an output opening, said output opening having a first transverse opening dimension ($x_1$); and an elongated chimney portion coupled to said converging transition portion adjacent said output opening, said elongated chimney portion having a second transverse opening dimension ($x_2$), said first transverse opening dimension ($x_1$) being smaller than said second transverse opening dimension ($x_2$), whereby as the granular material passes through said output opening having said first transverse opening dimension ($x_1$) into said elongated chimney portion having said second transverse opening dimension ($x_2$), relief of outward pressures created in the converging transition portion is provided to minimize bridging of the granular material within the container, wherein said elongated chimney portion is formed by a first cylindrical inclined portion and a second cylindrical inclined portion, whereby said second cylindrical inclined portion is operable to be rotated relative to said first cylindrical inclined portion to change a direction of flow of the granular material out of the container.

4. An apparatus for directing granular material through a container, said apparatus comprising:

a converging transition portion defining an input opening which converges to an output opening, said output opening having a first transverse opening dimension ($x_1$);

an elongated chimney portion coupled to said converging transition portion adjacent said output opening, said elongated chimney portion having a second transverse opening dimension ($x_2$), said first transverse opening dimension ($x_1$) being smaller than said second transverse opening dimension ($x_2$), whereby as the granular material passes through said output opening having said first transverse opening dimension ($x_1$) into said elongated chimney portion having said second transverse opening dimension ($x_2$), relief of outward pressures created in the converging transition portion is provided to minimize bridging of the granular material within the container; and a lower boot portion having a rotatable auger and an agitator operable to be located in a first position substantially in engagement with said auger and operable to be located in a second position elevated above and not in engagement with said auger.

5. The apparatus as defined in claim 4 further comprising a slide plate operable to expose said lower boot portion and move said agitator from said first position to said second position.

6. The apparatus as defined in claim 4 further comprising a removable external sidewall forming a portion of said lower boot portion, wherein upon removing said external sidewall, said auger is substantially exposed.

7. The apparatus as defined in claim 4 further comprising at least one adjustable baffle located within said lower boot portion, said adjustable baffle operable to be adjusted at a variety of angles to regulate the flow of granular material within the lower boot portion.

8. An apparatus for directing granular material through a container, said apparatus comprising:

a first cylindrical inclined portion coupled to the container;

a second cylindrical inclined portion rotatably coupled to said first cylindrical inclined portion; and a coupling flange disposed along a first inclined edge of said first cylindrical inclined portion and disposed along a second inclined edge of said second cylindrical inclined portion, wherein said second cylindrical inclined portion may be rotated relative to said first cylindrical inclined portion along said coupling flange to adjustably change a direction of routing the granular material out of the container.

9. The apparatus as defined in claim 8 further comprising a converging transition portion defining an input opening which converges to an output opening, said output opening having a first transverse opening dimension ($x_1$), wherein said first cylindrical inclined portion and said second cylindrical inclined portion have a second transverse opening dimension ($x_2$), said second transverse opening dimension ($x_2$) being larger than said first transverse opening dimension ($x_1$).

10. The apparatus as defined in claim 9 wherein said first cylindrical inclined portion and said second cylindrical inclined portion have a height dimension (y), wherein the ratio of said first transverse opening dimension ($x_1$) relative to said height dimension (y) is substantially determined by an angle of repose of the granular material to maintain a substantially uniform mass flow of the granular material out of the container.

11. The apparatus as defined in claim 8 further comprising a rotatable coupling mechanism disposed between said converging transition portion and said first cylindrical inclined portion, said rotatable coupling mechanism operable to enable said first and second cylindrical inclined portions to rotate 360° relative to said converging transition portion.

12. The apparatus as defined in claim 11 wherein said rotatable coupling mechanism includes an annular bead and an annular groove operable to mate with said annular bead along with a compression clamp operable to secure said elongated chimney portion relative to the container.

13. The apparatus as defined in claim 8 further comprising a lower boot portion having a rotatable auger and an agitator operable to be located in a first position substantially in engagement with said auger and operable to be located in a second position elevated above and not in engagement with said auger.

14. The apparatus as defined in claim 13 further comprising a slide plate operable to expose said lower boot portion and move said agitator from said first position to said second position.

15. The apparatus as defined in claim 13 further comprising a removable external sidewall forming a portion of said lower boot portion, wherein upon removing said external sidewall, said auger is substantially exposed.

16. The apparatus as defined in claim 13 further comprising at least one adjustable baffle located within said lower boot portion, said adjustable baffle operable to be adjusted at a variety of angles to regulate the flow of granular material within the lower boot portion.

17. An apparatus for directing granular material through a container, said apparatus comprising:

a rotatable auger operable to direct granular material out of the container as the rotatable auger is rotated; and an agitator operable to agitate said granular material as the granular material passes into said auger, said agitator operable to be located at a first position to agitate the granular material as said auger is rotated and operable to be located at a second position to substantially cease agitation of the granular material as said auger is rotated, wherein upon exposing said auger to the granular material, said agitator is located in said first position, wherein upon ceasing to expose said auger to the granular material, said agitator is located in said second position.

18. The apparatus as defined in claim 17 wherein said agitator is pivotably coupled to a pivot shaft.

19. The apparatus as defined in claim 18 wherein said agitator is operable to rotate about said pivot shaft.

20. The apparatus as defined in claim 17 wherein upon closing a slide plate, said agitator is moved from said first position in engagement with said auger to said second position out of engagement with said auger.

21. An apparatus for directing granular material through a container, said apparatus comprising:

a rotatable auger operable to direct granular material out of the container;

an agitator operable to agitate said granular material as the granular material passes into said auger, said agitator operable to be located at a first position substantially in engagement with said auger and operable to be located at a second position out of engagement with said auger, wherein upon exposing said auger to the granular material, said agitator is located in said first position; and a pair of adjustable baffles positioned adjacent to said agitator, said pair of adjustable baffles operable to be adjusted relative to said agitator to regulate the flow of granular material to said auger.

22. An apparatus for directing granular material through a container, said apparatus comprising:

a rotatable auger operable to direct granular material out of the container;

an agitator operable to agitate said granular material as the granular material passes into said auger, said agitator operable to be located at a first position substantially in engagement with said auger and operable to be located at a second position out of engagement with said auger, wherein upon exposing said auger to the granular material, said agitator is located in said first position; and an external removable sidewall, wherein upon removing said external removable sidewall, said auger is substantially exposed.

23. A container for storing granular material, said container comprising:

a cover portion operable to substantially cover the granular material stored in a container;

a sidewall member having an upper portion and a lower portion, said upper portion of said sidewall member being attached to said cover portion, said sidewall member being operable to confine the granular material stored in the container;

a converging portion attached to said lower portion of said sidewall member, said converging portion being operable to guide the granular material in the container to an outlet in said converging portion;

a lower outlet portion operable to direct the granular material out of the container; and a rotatable coupling mechanism disposed between said converging portion and said lower outlet portion, said rotatable coupling mechanism operable to permit said lower outlet portion to be rotated relative to the container, wherein said lower outlet portion can be rotated to adjustably direct the granular material out of the container.

24. The container as defined in claim 23 wherein said lower outlet portion may be rotated 360° relative to the container.

25. The container as defined in claim 23 wherein said lower outlet portion includes a converging transition portion defining an output opening having a first transverse opening dimension ($x_1$) and an elongated chimney portion coupled to said converging transition portion having a second transverse opening dimension ($x_2$), said first transverse opening dimension ($x_1$) being smaller than said second transverse opening dimension ($x_2$) to relieve outward pressures created in the converging transition portion as the granular material passes through the container.

26. The apparatus as defined in claim 23 wherein said elongated chimney portion is formed by a first cylindrical inclined portion and a second cylindrical inclined portion, whereby said second cylindrical inclined portion is operable to be rotated relative to said first cylindrical inclined portion to change a direction of flow of the granular material out of the container.

27. A method for directing granular material through a container, said method comprising:

providing a converging transition portion having a converging sidewall that converges to an output opening having a first transverse opening dimension ($x_1$);

providing an elongated chimney portion having a second transverse opening dimension ($x_2$), said first transverse opening dimension ($x_1$) being smaller than said second transverse opening dimension ($x_2$);

coupling said elongated chimney portion to said converging transition portion;

rotating the elongated chimney portion relative to the converging transition portion along a rotatable connection mechanism;

filling the container with the granular material; and moving the granular material from the container through the converging transition portion and the elongated chimney portion, whereby relief of outward feed pressures generated in the converging transition portion is provided.

28. A method for directing granular material through a container, said method comprising:

providing a converging transition portion having a converging sidewall that converges to an output opening having a first transverse opening dimension ($x_1$);

providing an elongated chimney portion having a second transverse opening dimension ($x_2$), said first transverse opening dimension ($x_1$) being smaller than said second transverse opening dimension ($x_2$);

providing a first cylindrical inclined portion and a second cylindrical inclined portion forming the elongated chimney portion and rotating the second cylindrical inclined portion relative to the first cylindrical inclined portion to adjustably direct the granular material out of the container;

coupling said elongated chimney portion to said converging transition portion;

filling the container with the granular material; and moving the granular material from the container through the converging transition portion and the elongated chimney portion, whereby relief of outward feed pressures generated in the converging transition portion is provided.

29. An apparatus for directing granular material through a container, said apparatus comprising:

a rotatable auger operable to direct granular material out of the container;

an agitator operable to agitate the granular material as the granular material passes into said auger; and a pair of adjustable baffles positioned adjacent to said agitator, said pair of adjustable baffles operable to be adjusted relative to said agitator to regulate the flow of granular material to said auger.

30. The apparatus as defined in claim 29 further comprising a rotatable coupling mechanism positioned above said rotatable auger, wherein said rotatable coupling mechanism is operable to enable 360° rotation to adjustably direct the granular material out of the container.

31. An apparatus for directing granular through a container, said apparatus comprising:

a rotatable auger operable to direct granular material out of the container;

an agitator operable to agitate the granular material as the granular material passes into said auger; and an external removable sidewall, wherein upon removing said external removable sidewall, said auger is substantially exposed.

32. The apparatus as defined in claim 31 further comprising a rotatable coupling mechanism positioned above said rotatable auger, wherein said rotatable coupling mechanism is operable to enable 360° rotation to adjustably direct the granular material out of the container.

33. The apparatus as defined in claim 32 wherein said agitator is operable to be located at a first position substantially in engagement with said auger and operable to be located in a second position out of engagement with said auger, wherein upon exposing said auger to the granular, said agitator is located in said first position.

* * * * *